US008631671B2

(12) United States Patent
Krajewski et al.

(10) Patent No.: US 8,631,671 B2
(45) Date of Patent: Jan. 21, 2014

(54) INTERNAL MANDREL AND METHOD

(75) Inventors: Paul E. Krajewski, Troy, MI (US); Michael H. Lovell, Leonard, MI (US); Tiffanie E. Coe, Sterling Heights, MI (US); Terry A. Kent, East China, MI (US); Kevin R. Marks, Durand, MI (US); William R. Rodgers, Bloomfield Township, MI (US); Howard William Cox, Bloomfield Hills, MI (US); William Parker, Garden City, MI (US); Darrell W. Rebman, Kimball Township, MI (US); John Collins, Troy, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 242 days.

(21) Appl. No.: 13/086,508

(22) Filed: Apr. 14, 2011

(65) Prior Publication Data

US 2012/0260709 A1 Oct. 18, 2012

(51) Int. Cl.
*B21D 9/15* (2006.01)
*B21D 17/00* (2006.01)

(52) U.S. Cl.
USPC ..... 72/62; 72/57; 72/60; 72/61; 29/421.1

(58) Field of Classification Search
USPC ..... 72/57, 58, 61, 62, 370.01, 370.05, 72/370.06, 370.22, 466.2, 466.7, 466.8; 29/421.1
See application file for complete search history.

(56) References Cited

U.S. PATENT DOCUMENTS

| | | | | | |
|---|---|---|---|---|---|
| 203,842 | A * | 5/1878 | Leland | 72/57 |
| 3,105,537 | A * | 10/1963 | Foster | 72/57 |
| 3,546,917 | A * | 12/1970 | Gardner et al. | 72/369 |
| 3,768,142 | A * | 10/1973 | Raczek | 29/421.1 |
| 4,667,497 | A * | 5/1987 | Oslin et al. | 72/62 |
| 4,751,835 | A * | 6/1988 | Galaniuk et al. | 72/62 |
| 5,505,068 | A * | 4/1996 | Bartels | 72/62 |
| 5,746,079 | A * | 5/1998 | Hettinger et al. | 72/57 |
| 5,813,266 | A * | 9/1998 | Ash | 72/57 |
| 6,662,447 | B2 * | 12/2003 | Kuschel et al. | 29/890.08 |
| 6,701,764 | B2 * | 3/2004 | Bruck et al. | 72/62 |
| 8,333,094 | B2 * | 12/2012 | Wolf | 72/149 |
| 2012/0260709 | A1 * | 10/2012 | Krajewski et al. | 72/57 |

* cited by examiner

*Primary Examiner* — David B Jones
(74) *Attorney, Agent, or Firm* — Quinn Law Group, PLLC

(57) ABSTRACT

A method and system for forming a part from a workpiece including a hollow portion, using a mandrel and a conventional press such as a stamping press includes filling the hollow portion of the workpiece with a mandrel material and transforming the mandrel material to form a mandrel. The mandrel material is removable from the formed part and may be recycled to form a mandrel for another workpiece.

14 Claims, 2 Drawing Sheets

INTERNAL MANDREL AND METHOD

TECHNICAL FIELD

The present invention relates to a method and system using a mandrel and conventional press to form a part from a hollow workpiece.

BACKGROUND

Numerous industrial and product applications require complex generally tubular shapes. For example, in the vehicle industry, vehicle components, such as vehicle frame rails, unibody components, suspension members, engine cradles and instrument panel support beams may be of tubular construction, where the component is often formed from a tubular member to define a generally rectangular cross-section. Tubes of a given diameter, for example, of the larger size required for vehicle applications, may buckle, stretch, wrinkle, and/or ripple if not sufficiently supported during the bending and forming processes. Forming of such tubular components in a conventional, e.g., standard mechanical or stamping press presents problems with sufficiently deforming the workpiece, which is provided as a tubular member, to form or flow the workpiece to fill the recesses of the die cavity defined by the upper and lower die, without collapsing, buckling or wrinkling the tubular structure of the workpiece.

Hydroforming processes have been developed to form complex tubular components by, generally, placing a tube or workpiece between a pair of dies such that as the dies merge, the ends of the tubular workpiece are sealed with a pair of sealing units. The workpiece is filled with a fluid, typically water or a water-glycerin mixture, which is then pressurized. Pressurizing the fluid within the workpiece results in forming and expanding the tube to conform to the cavity shape, wherein the pressurized fluid acts as a mandrel to support the interior surface of the tubular workpiece to prevent collapse or wrinkling of the tubular structure while the workpiece is deformed to conform with the configuration of the die cavity. The sealing units are removed prior to releasing the workpiece from the hydroforming press, and the hydroforming fluid is drained from the formed part. The primary disadvantages of hydroforming are cost and cycle time, the required use of specialized hydroforming presses equipped with hydraulics and high pressure pumps, extended cycle times for pressurizing and draining each workpiece, hydraulic fluid tanks and fluid management systems, and high maintenance cost and time. Additionally, some part configurations may require a pre-form operation of bending the workpiece using a bender and mandrel prior to forming the part using a hydroforming process.

SUMMARY

A method of forming a part from a workpiece including a hollow portion, using a mandrel and a conventional press, is provided. The workpiece may be, for example, a tube, and the part formed may be a tubular member such as a vehicle frame rail. The workpiece may be made of an aluminum alloy, a steel alloy, a magnesium alloy, an aluminum-containing material, a ferrous material, a magnesium-containing material, a metal or metal alloy. The method includes filling the hollow portion of the workpiece with a mandrel material and transforming the mandrel material to form a mandrel in the hollow portion within the workpiece. The part is formed from the workpiece using a conventional press and the mandrel, wherein the press exerts a force on the workpiece, typically through a die set, to deform the workpiece into the part. The mandrel supports the interior surface of the workpiece during deformation by the press and die set, with sufficient force to prevent collapse, buckling, wrinkling or other undesirable defects in the workpiece or part formed therefrom during the forming process. The mandrel may exert an incremental force facilitating or contributing to the deformation of the workpiece into or to conform to the die cavity.

As used herein, a conventional press is a press configured for the forming of a part without the use of traditional hydroforming equipment, methods and techniques such as hydroforming filling and sealing systems, high pressure pumps, hydroforming fluid drainage tanks and fluid storage systems to handle hydroforming fluids, etc. For example, a conventional press may be a stamping press or other mechanical or hydraulic press typically including a frame, bolster place and ram, into which a die set or die components may be configured. The die components, when closed by the press, exert a force on a workpiece placed in the die set to form a part from the workpiece. The closed die set defines a die cavity. The shape of the die cavity thus formed corresponds to the shape of the part formed by the press closing such that the die set exerts pressure on the workpiece.

The mandrel as described herein is removable from the part after forming. Removing the mandrel from the part may include shaking, vibrating, gravitating, dissolving, heating, melting and softening the mandrel or mandrel material, or a combination of these. The mandrel material may be recyclable such that the mandrel material, after removal from the formed part, may be reused to form a mandrel in another workpiece to be formed.

In a non-limiting example, the mandrel material may be a gas provided to the hollow portion of the workpiece through an opening in the workpiece. The opening may be sealed, and the gas provided to the hollow portion through the seal. The gas is compressed in the hollow portion to provide sufficient force against the inner surface of the workpiece defining the hollow portion so as to prevent collapse, buckling and/or wrinkling of the workpiece during forming. Additionally, during forming of the part by the press, the gas may be further compressed to provide an incremental force against the inner surface of the workpiece to facilitate deformation of the workpiece into the die cavity to form the part.

In another non-limiting example, the mandrel may include solid matter. The mandrel material may include solid matter prior to transformation into a mandrel, or may be transformed into a solid matter during forming of the mandrel.

The mandrel material may include, for example, one or a combination of a rubber compound, a synthetic rubber compound, a granular material, a dough, a clay, a modeling compound, a molding compound and sand which may be configured in the hollow portion of the workpiece by a filling or compaction method to a predetermined or minimum density sufficient to provide pressure against the inner surface of the workpiece to prevent collapse, buckling and/or wrinkling of the workpiece during forming in the conventional press.

The mandrel material may include a material characterized by a transition temperature such as a melting point, glass transition temperature, or freezing point, wherein the mandrel material above the transition temperature has an increased viscosity or is more readily flowable or formable. Examples include a low melting point metal alloy which is molten or liquid above its transition temperature (melting point) and solid below its melting point; a polymer which is softened or flexible above its transition temperature (glass transition temperature) and rigid or brittle below its glass transition temperature; or a fluid, which is in a fluid state above its transition temperature (freezing point) and in a solid state below its freezing temperature. Using a method described herein, the hollow portion of the workpiece may be filled with a mandrel material at a temperature exceeding the mandrel material transition temperature. The mandrel material may be subsequently cooled below its transition temperature, thus transforming the mandrel material into a mandrel including solid matter. The mandrel thus configured, e.g., with the mandrel material in a substantially solid state or comprising solid matter, may exert sufficient pressure against the inner surface of the workpiece to prevent collapse, buckling and/or wrinkling during forming, and/or exert incremental pressure to facilitate deforming the workpiece to conform to the die.

The mandrel material may include one of a gellable or foamable material, which may be exposed to or combined with, respectively, a gelling or foaming agent to form a mandrel consisting of, respectively, a gel or a foam. In a non-limiting example, a fluid may be combined with the gel or foam, such that the gel or foam are mixed or filled with the fluid, and/or the combination is cooled sufficiently to freeze or increase the viscosity of the fluid, wherein the combination of the mandrel materials form the mandrel. In another example, a solid material may be combined with the gellable or foamable material and incorporated in the mandrel formed therefrom.

Two or more mandrel materials may be combined and transformed to form a mandrel. The mandrel materials may be intermixed, or may be layered, partitioned or segmented in predetermined locations or portions of the hollow portion of the workpiece, to provide varying levels of pressure or force to the workpiece during forming, thus facilitating preferential material flow or deformation of predetermined sections of the workpiece in the die during forming of the part.

A system for forming a part from a workpiece including a hollow portion is provided herein. The system may include at least two die portions which together define a die cavity with a shape corresponding to the shape of the part being formed. The system may further include a conventional press, as that term is described herein, configured to apply pressure to the workpiece using the die portions, to form the part.

The workpiece includes an interior surface defining the hollow portion. The mandrel material may be configured to be transformed in the hollow portion of the workpiece into a mandrel to apply a mandrel force to the interior surface of the workpiece, e.g., to apply a sufficient force to the interior surface of the workpiece to prevent collapse, buckling and/or wrinkling of the workpiece and part during part formation by the die and press, and/or to facilitate deformation of the workpiece to conform with the die cavity during forming.

The system may further include one or more devices for transforming the mandrel material in the hollow portion of workpiece into the mandrel. One or more devices may be configured to compact or compress the mandrel material in the hollow portion of the workpiece to a predetermined density or pressure, to heat the mandrel material above a transition temperature prior to filling the hollow portion with the mandrel material, to cool the mandrel material below a transition temperature after insertion into the workpiece, to produce one of a gel and a foam using the mandrel material, or to combine or configure two or more mandrel materials together in the hollow portion of the workpiece, or to perform a combination thereof. One or more of the devices may be configured to seal an opening defined by the workpiece through which mandrel material is provided to the hollow portion, and/or to compress the mandrel against the interior surface of the workpiece during part formation in the press.

One or more of the devices may be configured to transport the workpiece into and/or out of the press and to facilitate removal of the mandrel from the formed part by one or more of shaking, vibrating, tilting, manipulating, or gravitating the formed part and/or mandrel, or by one or more of dissolving, heating, melting, softening, pushing, pulling, or extracting the mandrel or mandrel material to remove the mandrel material from the formed part. One or more of the devices may be configured to recycle the removed mandrel and/or mandrel material to provide recycled mandrel material for use in forming a mandrel for another workpiece.

The system and method described herein can be used with a conventional stamping press or press line. By eliminating the need to use a hydroforming press with its hydraulic pumps and related high pressure equipment required for the hydroforming process, the present method provides a significant reduction in cost and cycle time to form a part from a hollow workpiece. Additionally, the use of a mandrel and forming method as described herein may eliminate the need for a pre-forming operation to bend the workpiece prior to forming the part in the press. The process described herein may be advantaged by using a single stroke process with reduced cycle time to form a part from the workpiece. The above features and other features and advantages of the present invention are readily apparent from the following detailed description of the best modes for carrying out the invention when taken in connection with the accompanying drawings.

DETAILED DESCRIPTION

Figure 1A:
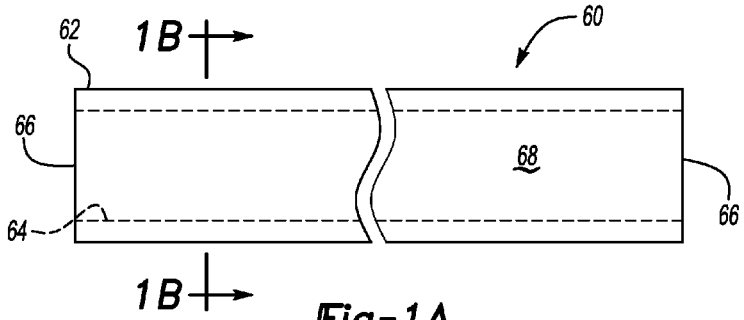
FIG. 1A is a schematic plan view of a workpiece defining a hollow portion.

Referring to the drawings wherein like reference numbers represent like components throughout the several figures. The elements shown in FIGS. 1-4B are not to scale or proportion. Accordingly, the particular dimensions and applications provided in the drawings presented herein are not to be considered limiting.

Figure 1B:
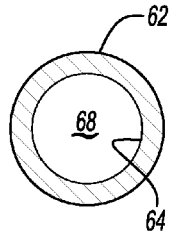
FIG. 1B is a schematic cross-sectional view of the workpiece of FIG. 1A.
Figure 2A:
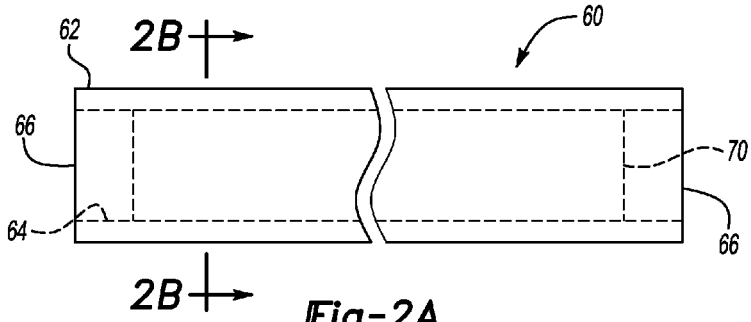
FIG. 2A is a schematic plan view of the workpiece of FIG. 1A showing the hollow portion filled with a mandrel material.
Figure 2B:
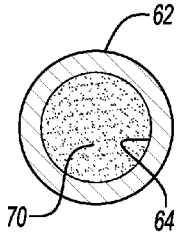
FIG. 2B is a schematic cross-sectional view of the workpiece of FIG. 2A showing the hollow portion filled with a mandrel material.

A method and system is provided for forming a part from a workpiece including a hollow portion, using a conventional press and a mandrel provided by transforming a mandrel material. FIGS. 1A and 1B show a workpiece 60 which defines a hollow portion 68. The workpiece 60 may define a generally round, oval, or rectangular cross-section. By way of non-limiting example, the workpiece 60 is shown in FIGS. 1A-2B as a tube or generally tubular section, including an exterior surface 62 and an interior surface 64 and defining a generally round cross-section as shown in FIGS. 1B and 2B. The interior surface 64 may define the generally hollow portion 68. The workpiece 60 may include one or more openings 66 to access the hollow portion 68. By way of non-limiting example, the workpiece 60 may be made of an aluminum alloy, a steel alloy, a magnesium alloy, an aluminum-containing material, a ferrous material, a magnesium-containing material, or may be made of another metal or metal alloy.

Figure 4A:
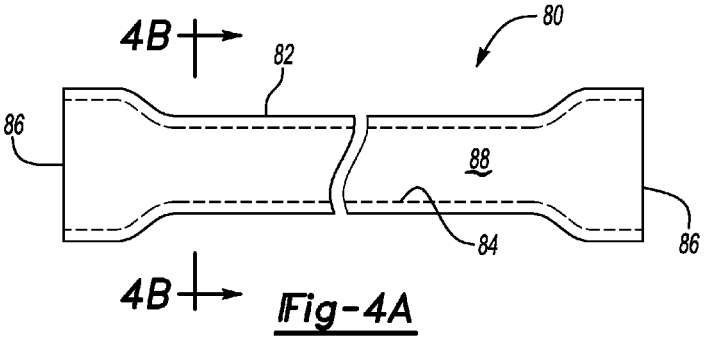
FIG. 4A is a schematic plan view of a part formed from the workpiece of FIG. 1A.
Figure 4B:
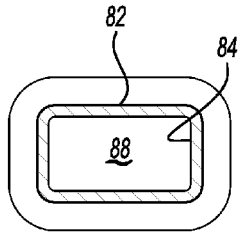
FIG. 4B is a schematic cross-sectional view of the formed part of FIG. 4A.

FIGS. 4A and 4B show a part 80 formed from the workpiece 60, which may be a generally tubular member including an exterior surface 82 and an interior surface 84. The interior surface 84 may define a hollow portion 88. The formed part 80 may include one or more openings 86 providing access to the hollow portion 88. The formed part 80 may be a structural component or a vehicle component, such as a vehicle frame rail, a unibody component, a suspension member, an engine cradle, or an instrument panel support beam of generally tubular construction, where the component is often formed to define a generally rectangular cross-section, such as the cross-section shown in FIG. 4B. The formed part 80 may be a non-vehicle component, and may typically be formed from a tubular workpiece having a diameter of 150 mm or greater. The formed part 80 shown in FIGS. 4*a* and 4B is intended to be non-limiting and it is understood that the formed part 80 may include additional bends, cross-sections of varying configurations, etc., which may be formed using the mandrels and methods described herein.

Figure 3:
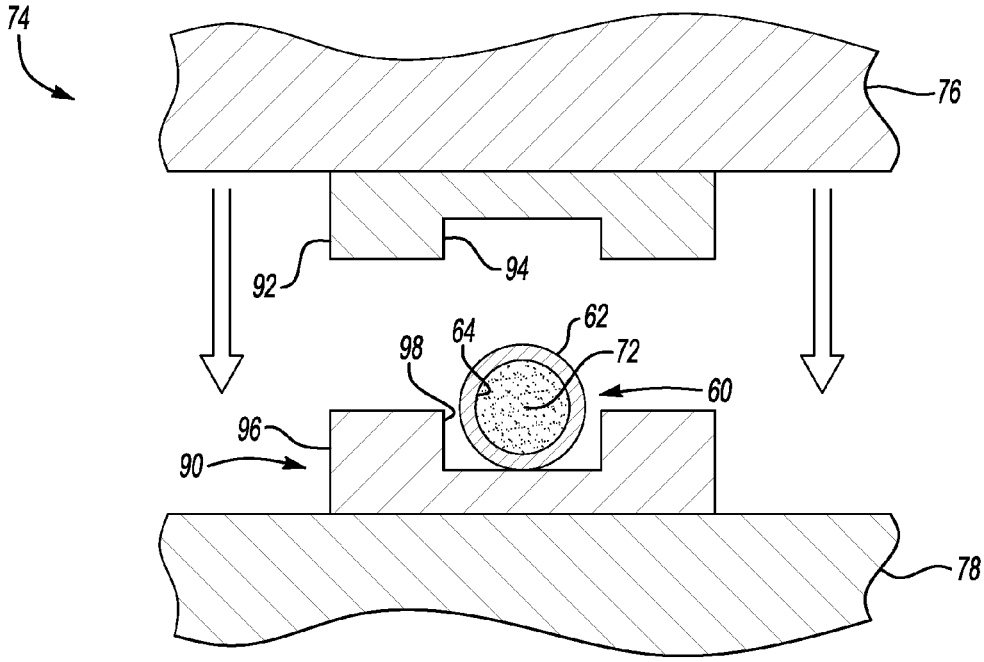
FIG. 3 is a schematic cross-sectional partial view of a press configured to form the workpiece of FIG. 1 using a mandrel.

Referring to FIG. 3, the workpiece 60, also referred to herein as a tube, is shown in a forming press 74 including a die set 90. The forming press 74 includes an upper press element 76, which may also be referred to as a ram, and a lower press element 78, which may also be referred to as a platen. The die set 90 may consist of more than one die. In a non-limiting example shown in FIG. 3, the die set 90 consists of at least two dies, an upper or first die 92 defining a die surface 94, and a lower or second die 96 defining a die surface 98. When the die set 90 is closed, for example, by lowering the ram 76 in the direction of the arrows shown in FIG. 3, the die surfaces 94 and 98 are brought together to define a die cavity of the die set 90.

When workpiece 60 is placed in the die set 90 for forming, the exterior surface 62 of the tube 60 may contact the surfaces 94, 98 of the die cavity as the die set 90 is closed, for example, by the press 74, such that the tube 60 is deformed and the exterior surface 62 is made to conform with the surfaces 94, 98 of the die cavity. The shape of the die cavity formed by the closed die set 90 corresponds to the shape of the part 80 to be formed from the tube 60.

The interior surface 64 of the workpiece 60 defines a hollow portion 68. The workpiece 60 may be configured with one or more openings 66 to the hollow portion 68. Using a tube-shaped workpiece 60 shown in FIGS. 1A-2B as an example, the tube 60 may be open at one or both ends, thus providing one or more openings 66 to access the hollow portion 68, e.g., the interior of the tube 60. During forming in a die set 90, it is desirable to position a mandrel 72, as shown in FIG. 3, in the hollow portion 68 of the workpiece 60 to prevent the workpiece 60 from collapsing or buckling into the hollow portion 68 when force from the die set 90 is exerted on the exterior surface 62 of the workpiece 60.

The mandrel 72 must be configured to provide sufficient pressure or force on the interior surface 64 defining the hollow portion 68 to resist collapse or buckling, and to prevent other defects from occurring during the forming operation including wrinkles, crinkles, folds or similar defects. The mandrel 72 may be configured to exert a forming pressure on the interior surface 64 of the workpiece 60, such that the mandrel forming pressure and the die forming pressure cooperate or are balanced to deform the workpiece 60 to conform to the die cavity and thereby form the part 80 without defects. The mandrel 72 may be manipulated during the forming operation to change the amount of pressure exerted by the mandrel 72 on the interior surface 64 of the workpiece 60. For example, the mandrel 72 may be compressed or compacted as the press 74 closes the die set to increase the mandrel force against the interior surface 64 of the workpiece 60 to counter or balance the increasing compressive force of the closing die set on the exterior surface 62 of the workpiece 60.

Figure 5:
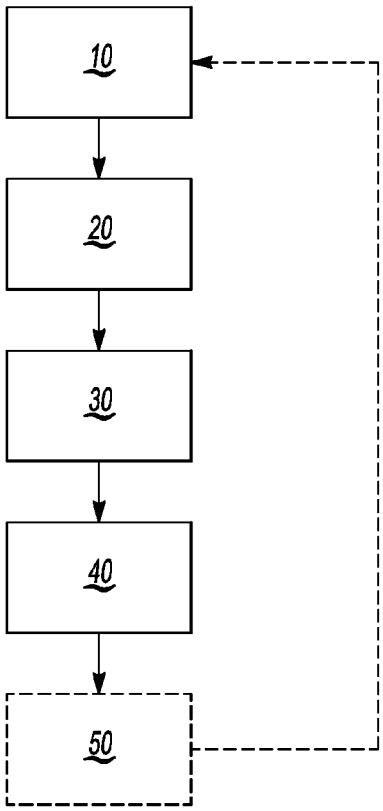
FIG. 5 is a schematic illustration of a method for forming a part using a mandrel.

In the method described herein and shown generally in FIG. 5, a mandrel 72 comprised of a mandrel material 70. The mandrel material 70 is shown in FIGS. 2A and 2B, where the mandrel material 70 shown in FIGS. 2A and 2B may be any of the mandrel materials discussed herein. It is preferable that the mandrel material 70 has a Poisson's ratio of less than 0.5 so that the mandrel 72 formed therefrom exhibits some compressibility. By way of non-limiting examples, various mandrel materials 70 are described herein, and each may be characterized by a Poisson's ratio. Some of the mandrel materials 70 may exhibit a Poisson's ratio in the range of 0.30-0.45 (for example, ice, certain clays, sands, polymers, alloys or foams). Other mandrel materials 70 may exhibit a Poisson's ratio approaching 0.50 (for example, certain rubbers, saturated clays, or fully hydrated gels).

Further, the various mandrel materials 70 and configurations of mandrels 72 described herein as non-limiting examples may contain matter (mandrel material) which may be in a solid, liquid, or gaseous state, or a combination thereof, wherein the mandrel material 70 may exist in one state prior to being transformed into the mandrel 72, and/or may be converted from one state to another state during part formation or the removal of the mandrel 72 from the formed part 80. The mandrel material 70 may consist of a combination of materials which are each in a different state to form the mandrel 72, for example, a liquid filled polymeric foam or fluid-entrapping gel.

FIG. 5 shows a method of forming a part, such as part 80 shown in FIGS. 4A and 4B, from a workpiece such as the generally tubular workpiece 60 shown in FIGS. 1A through 2B, using a mandrel 72 and a conventional press 74 as generally shown in FIG. 3. The method includes, as depicted in step 10, filling the hollow portion 68 of the workpiece 60 with a mandrel material 70 (see FIGS. 2A and 2B) and transforming the mandrel material 70 to form a mandrel 72 (see FIG. 3), as depicted in step 20. The part 80 is formed from the workpiece 60, as depicted in step 30 and shown in FIG. 3, using the mandrel 72 and a conventional press 74. As used herein, a conventional press 74 is a press configured for the forming of a part 80 without the use of traditional hydroforming equipment such as hydroforming filling and sealing systems, high pressure pumps, hydroforming fluid drainage and storage systems, etc. For example, the conventional press 74 may be a stamping press or other mechanical or hydraulic press typically including a frame, bolster place and ram, into which a die set or die components may be configured.

The workpiece 60 may be sealed (not shown) to contain and/or compress or compact the mandrel material 70 in the workpiece 60, and may be unsealed to facilitate removal of the mandrel material 70. The type of mandrel material 70, method used to transform the mandrel material 70, and/or the use of the mandrel 72 in forming the part 80 may determine the method of and sequence for sealing and unsealing the workpiece 60. The workpiece 60 may be sealed by closing the openings 66 to the hollow portion 68. By way of example, for a workpiece 60 configured as a tube, the open ends of the tube 60 may be closed by crimping, capping, welding, staking, bending or folding the end portions of the tube 60 to produce a seal. The seal may fully or partially close the opening 66 to the hollow portion 68 of the workpiece 60, in this event, the tube. The workpiece 60 may be considered sealed when the opening 66 is sufficiently closed to contain the mandrel material 70 to form the mandrel 72.

For example, a mandrel 72 formed from a gas may require a complete closure or sealing of the hollow portion 68 of the workpiece 60 to contain and compress the gas. In this instance, the workpiece 60 may be sealed and the mandrel material 70, a gas, provided to the hollow portion 68 of the workpiece 60 through a sealing mechanism (not shown), which may be a removable end cap, end effector, axial punch or other component sealable to a surface of the workpiece 60. As another example, a mandrel 72 formed from a rubber compound may require only partial closure of the openings 66 sufficient to contain the rubber compound in the hollow portion 68 while still permitting, for example, air flow through the closure.

The mandrel 72 is removable from the part 80 after forming, as depicted in FIG. 5 at step 40. The method used to remove the mandrel material 70 may be determined by the type of mandrel material 70, and may include shaking, vibrating, gravitating, dissolving, heating, melting and softening the mandrel 72 or mandrel material 70, or a combination of these. The mandrel material 70 may be recyclable, as depicted at step 50, such that the mandrel material 70, after removal from the hollow portion 88 of the formed part 80, may be reused to form a mandrel in another workpiece to be formed.

In a first example, the mandrel material 70 may be one of or a combination of a rubber compound, a synthetic rubber compound, a granular material, a dough, a clay, a putty, a modeling compound, a molding compound, sand or other compressible granular or polymeric media. By way of example, the mandrel material 70 may comprise materials such as ground or shredded rubber tires, PlayDoh®, or a rubber material with a high coefficient of restitution such as synthetic rubber polymer polybutadiene containing, but not limited to hydrated silica, zinc oxide, stearic acid, and other ingredients, which may be configured, for example, as a sphere or ball. A non-limiting example of the latter includes the synthetic rubber balls commonly referred to as SuperBalls®. The hollow portion 68 of the workpiece 60 is filled at step 10 with the mandrel material 70 by any suitable means for the type of material, which may include, for example, inserting, pouring, or stacking the mandrel material 70 in the workpiece 60. One or more openings 66 to the hollow portion 68 may be sealed prior to filling the workpiece 60. For example, the opening 66 at one end of a tube 60 may be sealed to create a close ended hollow portion 68, to facilitate filling the workpiece 60 with the mandrel material 70. Alternatively, the filling process may occur concurrently through more than one opening 66 to the hollow portion 68 to improve the efficiency and/or effectiveness of the filling process.

At step 20, in the present example, the mandrel material 70 is transformed into a mandrel 72 by configuring the mandrel material 70 to a predetermined density in the hollow portion 68 of the workpiece 60, where the predetermined density is typically a packed and/or compressed density which is greater than the density of the mandrel material 70 as configured prior to being located in the hollow portion 68. Using the example of a spherical component, such as a SuperBall® or other rubber or polymeric ball, the balls may be packed into the hollow portion 68 of the workpiece 60 in a configuration to achieve the highest packing density, thus maximizing the uncompressed density of the mandrel 72 formed from the balls. Additionally, the balls may be compressed to increase their packed density to a minimum or predetermined density and may then be sealed in the hollow portion 68 to contain the balls at the predetermined density in the workpiece 60 during the forming operation. The minimum density of the mandrel 72 may be predetermined to provide a desired compressibility or Poisson's ratio of the mandrel 72, as required for defect free formation of the part 80 from the workpiece 60 using a conventional press 74.

At step 30, the part 80 is formed by placing the workpiece 60 in a conventional press 74, where the press 74 is closed to exert pressure on the workpiece 60 in a die set to deform the workpiece 60 into the part 80. As discussed previously, the ends or openings 66 of the workpiece 60 may be sealed by any suitable means, including the use of a sealing component, such as a sealing ram or punch which may be fitted to the opening 66 or in the hollow portion 68 and manipulated during the forming operation to selectively change the compression of the mandrel 72 as the press 74 closes the die set to form the part 80.

After the part 80 is formed, at step 40, the mandrel material 70 is removed from the formed part 80 by any suitable means, which may include, for example, unsealing the ends of the part 80 by removing a sealing element or removing or opening the sealed portion of the part 80. The mandrel 72 may be removed from the part 80 by, for example, tilting, manipulating, vibrating, and/or shaking the part 80 to loosen the mandrel material 70, by extracting, pushing, pulling or rinsing out or blowing out the mandrel material 70 from the hollow portion 88. Optionally, the mandrel material 70 may be recycled at step 50 to be reused in forming a mandrel in another workpiece.

In another example, the mandrel material 70 may be a low melting point metal alloy, such as an alloy containing tin and/or bismuth, or other alloy characterized by a melting point below 150° C. or as a low melting point alloy, for example, under ASTM B774-00 or a similar standard or classification. At step 10, the alloy may be heated above the melting point to become substantially liquid, and the hollow portion 68 of the workpiece 60 filled with the liquid alloy. As discussed previously, the workpiece 60 may be sealed to contain the liquid mandrel material 70 or otherwise manipulated to contain the alloy in its liquid state. At step 20, the mandrel material 70, e.g., the alloy, is cooled below its transition temperature, e.g., its melting point, such that the alloy solidifies in the hollow portion 68 of the workpiece 60 to form the mandrel 72. After forming at step 30, the mandrel 72 may be heated above the melting point of the alloy and the liquid metal removed from the formed part 80 by draining, for example, at step 40. The mandrel material 70, e.g., the alloy, may be recycled at step 50 to form a mandrel in another workpiece.

The mandrel material 70 may comprise a fluid, which may be a water-containing fluid, or another fluid or solution, provided to the hollow portion 68 of the workpiece 60 in a liquid or semi-liquid state at step 10. As discussed previously, the workpiece 60 may be sealed to contain the liquid mandrel material 70 or otherwise manipulated to contain the liquid. At step 20, the mandrel material 70, e.g., the fluid, is cooled below its transition temperature, e.g., its freezing point, such that the fluid solidifies in the hollow portion 68 of the workpiece 60 to form the mandrel 72. In a non-limiting example, the fluid may be water which is partially or fully frozen to form a mandrel 72 made of dense slush or ice. After forming at step 30, the mandrel 72 may be heated above the freezing point of the fluid to soften or melt the mandrel 72, and the resulting slush and/or fluid removed from the formed part 80 by draining, for example, at step 40. The mandrel material 70, e.g., the fluid or solution, may be recycled at step 50 to form a mandrel in another workpiece. Using a mandrel 72 such as ice lowers the temperature of the workpiece 60, which in the case of an aluminum workpiece 60, may enhance the formability of the workpiece 60 in the die.

In another example, the mandrel material 70 comprises a foamable polymer. The foamable polymer may be transformed into a mandrel 72 including polymeric foam, which may be a rigid or semi-rigid polymeric foam configured to substantially fill the hollow portion 68 of the workpiece 60. The mandrel 72 may be formed from the foamable polymer by combining the foamable polymer and a forming agent to form a polymeric foam at step 20, which may be done, for example, in situ in the hollow portion 68 of the workpiece 60. The polymeric foam may be combined with another mandrel material 70 to increase the density or change the compressibility of the mandrel 72 formed therefrom. For example, the polymeric foam may be combined with a fluid, and the fluid may be cooled sufficiently to partially or fully freeze the fluid. The polymeric foam may be removed from the formed part 80 at step 40, for optional recycling at step 50. Alternatively, the foam may remain in the formed part 80, for example, to provide the formed part 80 with additional noise insulating, vibration dampening, or energy absorption properties.

In another example, the mandrel material 70 comprises a gellable material, and transforming the mandrel material 70 includes combining the gellable material, which may be provided as a solution, and a gelling agent into a gel, thus forming a mandrel 72 including the gel. Various methods may be used to form the gel. For example, the interior surface 64 of the hollow portion 68 may be coated with a gelling agent prior to filling the hollow portion 68 with the gellable material at step 10, such that the gellable material and the gelling agent combine in the hollow portion 68 to form the gel therein at step 20. The gelling agent and the gellable material may be combined during the process of filling the hollow portion 68 of the workpiece 60 with gellable material, such that they are combined and reacted with each other during the filling process, e.g., step 10 and step 20 occur simultaneously.

In a non-limiting example, the gel may be a hydrogel such as a gel formed from alginate. The gellable material, in this case, may be alginates in a freely flowing solution and present as sodium salts. The gelling agent may include one of divalent ions such as calcium ions, or trivalent ions such as aluminum ions. The alginate gel forms when the sodium ions in the alginate solution are exchanged for divalent or trivalent ions. The concentration of the alginate in the solution may be varied to vary the stiffness or flexibility of the gel formed therefrom, thus affecting the compressibility and/or Poisson's ratio of the mandrel 72 including the gel. In one configuration, the interior surface 64 of the workpiece 60 may be coated with a calcium or aluminum salt, and the hollow portion 68 filled with the alginate solution, where it reacts with the salt coating to form a gel in situ. In another configuration, the alginate solution may be poured into the hollow portion 68 of the workpiece 60 through, for example, a screen comprising a calcium or aluminum salt, such that the gellable material (the alginate solution) and the gelling agent (the calcium or aluminum salt) are combined and react with each other during the filling process, to fill the hollow portion 68 with the solidified (gelled) alginate. The part 80 is formed at step 30, using the mandrel 72 comprised of the gel. At step 40, the gel may be exposed, for example, to a sodium chloride solution such that the gel is partially or fully dissolved, e.g., converted to a solution, making the mandrel 72 formed therefrom removable from the part 80. At step 50, the mandrel material 70 may be recycled.

In another example, the mandrel material 70 comprises a polymer. In one configuration, at step 10, the hollow portion 68 of the workpiece 60 may be filled with the polymer defined by a glass transition temperature, wherein the polymer is at a temperature above its glass transition temperature, such that the polymer is in a flexible or softened state to facilitate the filling process. The polymer material 70 is transformed at step 20 into a mandrel 72 by cooling the polymer below a glass transition temperature defined by the polymer, such that the polymer becomes stiffer and/or more brittle, thereby changing the compressibility of the polymer to make it suitable for use as a mandrel 72. The workpiece 60 is formed into a part 80 at step 30, using the press 74 and the mandrel 72 as discussed previously. At step 40, the mandrel material 70, e.g., the polymer, may be heated above its glass transition temperature, thereby softening or increasing the flexibility of the polymer to assist the removal of the mandrel 72 from the formed part 80. The removed mandrel material 70 may be recycled at step 50 for use to form a mandrel in another workpiece.

In another configuration, the hollow portion 68 may be filled at step 10 with the polymer material 70, and transformed into a mandrel 72 at step 20 by configuring the polymer to a predetermined density, for example, by packing the polymer in a packing pattern or selected orientation, or by compressing the polymer in the hollow portion 68 to achieve a minimum density, or a combination thereof. The polymer material 70 may be combined with another material or fluid to affect the compressibility and/or density of the mandrel 72 formed from the combined mandrel materials 70. In a non-limiting example, the polymer material 70 may be a textile or other woven material, which may be, for example, saturated or combined with a lubricating fluid such as an oil or synthetic oil to facilitate insertion/removal of the polymer material to/from the workpiece/formed part 60/80. After forming the part 80 at step 30, the polymer material 70 may be removed from the hollow portion 88, for example, by extraction by pushing or pulling the material 70 from the formed part 80, or other suitable method. The polymer material 70 may be recycled at step 50 for reuse to form a mandrel in another workpiece.

In another example, the mandrel material 70 comprises a gas, which is transformed into the mandrel 72 by compression of the gas in the hollow portion 68 of the workpiece 60. At step 10, the one or more openings 66 to the hollow portion 68 is sealed prior to filling the hollow portion 68 with the gas using, for example, an end cap, sealing ram or other sealing mechanism which may be configured such that the gas can be introduced to and pressurized in the hollow portion 68 using the sealing mechanism. The gas is provided to the hollow portion 68 at step 10 through the sealed opening 66, then compressed at a step 20 to a first pressure to apply a first force against the interior surface 64 defining the hollow portion 68 to form the mandrel 72. The gas may be further compressed during the forming process at step 30 to a second pressure to apply a second force to the interior surface 64 during formation of the part 80, where the second pressure is sufficient to facilitate deformation of the workpiece 60 to conform to the die cavity. At step 40, the pressurized gas is released from the formed part 80. In a non-limiting example, the gas may be compressed air provided by a pneumatic system in the facility in which the press 74 is located. In this case, the compressed air can be provided to the part forming operation from an existing resource (the building compressed air system) without incremental cost and without modification of the press 74 to provide for an air supply.

Other configurations and forming sequences are possible. For example, at step 10 the hollow portion 68 may be coated or lined with another material, which may be configured as a lubricant, sleeve, shroud, etc., to provide an interface layer between the mandrel material 70 and the interior surface 64 of the workpiece 60. The interface layer may act as a lubricant to facilitate insertion/removal of the mandrel material 70 into/from the workpiece/formed part 60/80. The interface layer may react or combine with the mandrel material 70 to transform the mandrel material 70 into the mandrel 72. The interface layer may be a protective layer applied to the interior surface 64 as, for example, a corrosion preventative, or to insulate the interior surface 64 from the mandrel material 70 such that the mandrel material 70 does not react with or adhere to the interior surface 64. The interface layer may be transformable to facilitate removal of the mandrel material 70 by, for example, dissolving in the presence of a solvent provided to the hollow portion 88 of the part 80 after forming the part 80, or by melting at a temperature lower than the mandrel material 70, such that the part 80 can be heated after forming to create a liquid or lubricating or softened layer between the mandrel material 70 and the interior surface 64 of the part 80 to assist in removal of the mandrel material 70.

The mandrel 72 may include, as discussed previously, more than one mandrel material 70, where step 10 may include filling the hollow portion 68 of the workpiece 60 with a combination of a plurality of mandrel materials 70, such as a first mandrel material and a second mandrel material, where at least one of the mandrel materials 70 is transformed to form the mandrel 72. The two or more mandrel materials 70 may be intermixed, or may be layered, partitioned or segmented in predetermined locations or portions of the hollow portion 68 of the workpiece 60, to provide varying levels of pressure or force to the workpiece 60 during forming, thus facilitating preferential material flow or deformation of predetermined sections of the workpiece 60 in the die during forming of the part 80. In another configuration, one of the plurality of mandrel materials 70 may be configured to seal or contain another of the plurality of mandrel materials 70 in the hollow portion 68 of the workpiece 60.

The method may include additional forming operations or processing steps performed prior to removing the mandrel 72 from the formed part 80 at step 40. For example, after step 30, the formed part 80 including the mandrel 72 may be transferred to a secondary operation which may include, for example one or a combination of additional forming or bending of the formed part 80, forming holes or openings by drilling, punching, cutting or other suitable processes, wherein the mandrel 72 may be used to support interior surface 84 of the formed part 80 during the secondary operation to minimize, for example, wrinkling, creasing, edge tearing, springback or other defects.

A system of forming a part 80 from a workpiece 60 including a hollow portion 68, using a mandrel 72 is also provided. The system may include two or more die portions, for example, die portions 92, 96 shown in FIG. 3, which together define a cavity with a shape corresponding to the shape of the part 80 being formed, and a conventional press 74 configured to apply pressure to the workpiece 60 using the die portions 92, 96 to form the part 80. The conventional press 74, as described previously and as that term is used herein, may be a stamping press or other hydraulic or mechanical press which is configured to form a part 80 from a workpiece 60 including a hollow portion 68, which may be, for example, a generally tubular workpiece 60. The conventional press 74 may be characterized by an absence of the fixtures, equipment, controls and additional features such as hydroforming fluid management systems, associated with a hydroforming operation or hydroforming press, or may be characterized as a press 74 which is configured to form a part 80 using a mandrel 72 as described herein without the use of fixtures, controls and fluid management equipment typically associated with a hydroforming operation.

The system further includes a workpiece 60 configured to include a hollow portion 68 defined by an interior surface 64 of the workpiece 60, and a mandrel material 70 configured to be transformed into a mandrel 72 configured to apply a mandrel force to the interior surface 64 of the workpiece 60, e.g., to apply a sufficient force to the interior surface 64 of the workpiece 60 to prevent collapse, buckling and/or wrinkling of the workpiece 60 and part 80 during part formation by the die and press 74, and/or to facilitate deformation of the workpiece 60 to conform with the die cavity during forming, as previously described. The workpiece 60 may be configured as a tube, or generally tubular structure, such as that which would be used for the formation of a vehicle component such as a vehicle rail, engine cradle, unibody component, suspension component, etc. Other workpiece configurations are possible for forming into a part 80 using a mandrel 72 and mandrel forming process as described herein. For example, the workpiece configuration may not be limited to a generally uniform or symmetrical configuration such as a tubular configuration. The workpiece 60 may define a hollow portion 68 which is asymmetrical or non-uniform, for example.

The system may further include one or more devices (not shown) for transforming the mandrel material 70 in the hollow portion 68 of workpiece 60 into the mandrel 72. One or more devices may be configured to compact or compress the mandrel material 70 in the hollow portion 68 of the workpiece 60 to a predetermined density or pressure, to heat the mandrel material 70 above a transition temperature prior to filling the hollow portion 68 with the mandrel material 70, to cool the mandrel material 70 below a transition temperature after insertion into the workpiece 60, to produce one of a gel and a foam using the mandrel material 70, or to combine or configure two or more mandrel materials 70 together in the hollow portion 68 of the workpiece 60, or to perform a combination thereof One or more of the devices may be configured to seal an opening 66 defined by the workpiece 60 through which mandrel material 70 is provided to the hollow portion 68, and/or to compress the mandrel 72 against the interior surface 64 of the workpiece 60 during part formation in the press 74.

One or more of the devices may be configured to transport the workpiece 60 into and/or out of the press 74 and to facilitate removal of the mandrel 72 from the formed part 80 by one or more of shaking, vibrating, tilting, manipulating, or gravitating the formed part 80 and/or mandrel 72, or by one or more of dissolving, heating, melting, softening, pushing, pulling, or extracting the mandrel 72 or mandrel material 70 to remove the mandrel material 70 from the formed part 80. One or more of the devices may be configured to recycle the removed mandrel 72 and/or mandrel material 70 to provide recycled mandrel material for use in forming a mandrel for another workpiece.

While the best modes for carrying out the invention have been described in detail, those familiar with the art to which this invention relates will recognize various alternative designs and embodiments for practicing the invention within the scope of the appended claims.

The invention claimed is:

1. A method of forming a part from a workpiece including a hollow portion, using a mandrel, the method comprising:

filling the hollow portion of the workpiece with a mandrel material;

wherein the mandrel material comprises a gellable material;

transforming the mandrel material to form a mandrel; and forming the part using the mandrel and a conventional press;

wherein the mandrel is removable from the part after forming.

2. The method of claim 1, wherein the mandrel includes solid matter.

3. The method of claim 1, wherein transforming the mandrel material includes combining a gelling agent and the gellable material to form a gel by one of:

coating the interior surface defining the hollow portion with the gelling agent prior to filling the hollow portion with the gellable material, and combining the gelling agent and the gellable material concurrent with filling the hollow portion of the workpiece with the mandrel material.

4. The method of claim 1, wherein the gellable material is one of a hydrogel and an alginate, and the gelling agent includes one of divalent ions, calcium ions, trivalent ions, and aluminum ions.

5. The method of claim 1, wherein forming the part further comprises compressing the mandrel concurrently with forming the part, such that the mandrel applies an incremental pressure to the interior surface defining the hollow portion.

6. The method of claim 1, further comprising:

filling the hollow portion of the workpiece with a combination of a first mandrel material and a second mandrel material;

wherein the first mandrel material comprises the gellable material;

transforming at least one of the first and second mandrel materials to form the mandrel; and wherein the first and second mandrel materials are removable from the part after forming the part.

7. The method of claim 1, wherein the mandrel material is removable from the part by at least one of shaking, vibrating, gravitating, dissolving, heating, melting and softening the mandrel.

8. The method of claim 1, further comprising:

removing the mandrel material from the part after forming; and recycling the mandrel material.

9. A system of forming a part from a workpiece including a hollow portion, using a mandrel, the system comprising:

at least two die portions which together define a cavity with a shape corresponding to the shape of the part being formed;

a conventional press configured to apply pressure to the workpiece using the die portions to form the part;

wherein the workpiece includes an interior surface defining the hollow portion;

a mandrel material configured to be transformed in the hollow portion of the workpiece into a mandrel configured to apply a mandrel force to the interior surface of the workpiece; and wherein the mandrel material comprises a gellable material.

10. The system of claim 9, wherein the mandrel includes solid matter.

11. The system of claim 9, further comprising:

a device for transforming the mandrel material in the hollow portion of workpiece into the mandrel, the device configured to at least one of:

compact the mandrel material to a predetermined density, cool the mandrel material below one of a melting point, a freezing point, and a glass transition temperature of the mandrel material, and combine a mandrel material and another material to transform the mandrel material into one of a gel and a foam.

12. The system of claim 9, wherein the workpiece defines at least one opening to the hollow portion, the system further comprising:

a seal configured to at least one of:

seal the at least one opening, contain the mandrel material in the workpiece, and compress the mandrel to apply incremental pressure to the interior surface of the workpiece during formation of the part.

13. A method of forming a part from a workpiece including a hollow portion, and using a mandrel, the method comprising:

filling the hollow portion of the workpiece with a mandrel material;

transforming the mandrel material into a mandrel including solid matter, wherein the transformation includes one of:

compacting the mandrel material, cooling the mandrel material below one of a melting point, a freezing point, and a glass transition temperature of the mandrel material, and forming one of a gel and a foam including the mandrel material;

forming the part using the mandrel and a press, wherein the press is operated as a conventional press;

removing the mandrel material from the part after forming; and recycling the mandrel material.

14. The method of claim 13, wherein the mandrel material comprises a gellable material.

* * * * *